US008650842B2

(12) United States Patent
Stollery et al.

(10) Patent No.: US 8,650,842 B2
(45) Date of Patent: Feb. 18, 2014

(54) PACKING OF BOXED GLOVES

(75) Inventors: Jonathan William Stollery, Woodbridge (GB); Kim Marie Stollery, Woodbridge (GB)

(73) Assignee: Altevo Limited (GB)

( * ) Notice: Subject to any disclaimer, the term of this patent is extended or adjusted under 35 U.S.C. 154(b) by 161 days.

(21) Appl. No.: 13/060,146

(22) PCT Filed: Aug. 20, 2009

(86) PCT No.: PCT/GB2009/002033

§ 371 (c)(1),
(2), (4) Date: Mar. 16, 2011

(87) PCT Pub. No.: WO2010/020782

PCT Pub. Date: Feb. 25, 2010

(65) Prior Publication Data

US 2011/0162325 A1 Jul. 7, 2011

(30) Foreign Application Priority Data

Aug. 20, 2008 (GB) ..... 0815156.5
Mar. 30, 2009 (GB) ..... 0905483.4

(51) Int. Cl.
*B65B 5/10* (2006.01)
*B65B 25/20* (2006.01)
*B65B 35/50* (2006.01)

(52) U.S. Cl.
USPC ..... 53/447; 53/475; 53/536; 53/540; 53/242; 53/247; 53/258; 100/229 A; 100/245; 100/293

(58) Field of Classification Search
CPC ..... B65B 35/50; B65B 25/20; B65B 5/108; A61B 19/045
USPC ..... 53/447, 475, 535, 536, 540, 541, 242, 53/247, 258; 100/229 A, 240, 245, 293
IPC ..... B65B 5/10,25/20, 35/50
See application file for complete search history.

(56) References Cited

U.S. PATENT DOCUMENTS 567,896 A * 9/1896 Gibon ..... 53/536
797,752 A * 8/1905 Roth ..... 53/242

(Continued)

FOREIGN PATENT DOCUMENTS

GB 2245879 1/1992
GB 2420107 5/2006

(Continued)

OTHER PUBLICATIONS

International Search Report in PCT/GB2009/002033, Dec. 8, 2009, EPO, 6 pages.

(Continued)

*Primary Examiner* — Stephen F Gerrity
(74) *Attorney, Agent, or Firm* — Bourque and Associates, PA

(57) ABSTRACT

The present invention relates to a glove packing apparatus for packing gloves into a box, and to a method of packing gloves into a box, particularly to the packing of disposable medical gloves. A glove packing apparatus (1) for packing gloves into a box comprises a receptacle (26) for forming a stack of gloves to be packed, the receptacle having a perimeter wall (24, 25) for containing a stack of gloves, a floor (22) within the perimeter wall for supporting the stack of gloves, and an opening (27) opposite the floor into which additional gloves may be added to during stacking of gloves. The floor (22) is movable relative to the perimeter wall (24, 25), so that, in use, the floor may be moved relatively away from the receptacle opening (27) so that as gloves are added to said stack of gloves, the perimeter wall continues to contain the stack of gloves. The floor (22) may then be moved relatively toward the opening to remove the stack of gloves from the receptacle (26).

30 Claims, 9 Drawing Sheets

(56) References Cited

U.S. PATENT DOCUMENTS

| | | | | | |
|---|---|---|---|---|---|
| 797,753 | A | * | 8/1905 | Roth | 53/258 |
| 797,754 | A | * | 8/1905 | Roth | 53/258 |
| 1,855,846 | A | * | 4/1932 | Shimer | 53/399 |
| 2,500,819 | A | * | 3/1950 | Hall et al. | 53/242 |
| 2,638,256 | A | * | 5/1953 | Hagen et al. | 53/242 |
| 3,479,796 | A | * | 11/1969 | Blunt | 53/242 |
| 3,908,539 | A | * | 9/1975 | O'Brien | 53/540 |
| 5,042,233 | A | * | 8/1991 | Huang et al. | 53/242 |
| 6,840,025 | B1 | | 1/2005 | Chapman | |

FOREIGN PATENT DOCUMENTS

| | | |
|---|---|---|
| JP | 6432098 | 2/1989 |
| JP | 04239405 | 8/1992 |
| JP | 09142406 | 6/1997 |

OTHER PUBLICATIONS

Written Opinion of the International Searching Authority in PCT/GB2009/002033, Dec. 8, 2009, EPO, 6 pages.

Search Report in GB0815156.5, Dec. 5, 2008, UK Intellectual Property Office, 3 pages.

Search Report in GB0905483.4, Oct. 29, 2009, UK Intellectual Property Office, 3 pages.

International Preliminary Report on Patentability in PCT/GB2009/002033, Jul. 3, 2010, EPO, 9 pages.

Grant Decision of Japanese Patent Application 2011-523448, Jul. 24, 2013, Japanese Patent Office, 4 pages.

* cited by examiner

PACKING OF BOXED GLOVES

BACKGROUND a. Field of the Invention

The present invention relates to a glove packing apparatus for packing gloves into a box, and to a method of packing gloves into a box, particularly to the packing of disposable medical gloves.

b. Related Art

The control of infection of patients in hospitals, clinics, and doctors' surgeries has become an ever more pressing concern with the rise of infectious bacteria resistant to multiple antibiotics, in particular methicillin-resistant staphylococcus aureus (MRSA) and *Clostridium dificile* (*C. dificile*). In the United Kingdom alone there are thought to be about 5,000 deaths a year from infections caught in hospitals but some experts believe the number could be as high as 20,000.

Disposable medical gloves can help prevent cross-contamination, but a problem arises if external parts of the glove touch the same areas of a dispensing container as have previously been touched by hands which are contaminated with harmful micro-organisms. Such external parts of the gloves can then become contaminated prior to contact with a patient, if these external parts are the fingers or palm area of the glove the likelihood of a patient being contaminated is dramatically increased.

Most gloves used in hospitals and clinics are examination gloves, and these are used in large numbers. Such gloves are supplied not in individual sterile packages, but in relatively inexpensive cardboard dispensing boxes. The size of boxed gloves is an issue owing to the need to minimise the space needed to store gloves, or the size of dispensing apparatus holding boxed gloves.

Because of the enhanced infection control properties the preferred method of dispensing these gloves is by the cuff, so that the user can only remove the gloves from the container by the cuffs rather than by the fingers etc. However in order to remove the gloves by the cuff there is a danger that the users hands will contaminate the edges of the area of the box through which the gloves have to pass, increasing the possibility that any contamination on the hands of the user can then be transferred to the gloves if they touch these areas when removing them from the container.

It is an object of the present invention to provide a means by which during removal of the gloves from the container, the gloves can be prevented from contact with the areas which could have been previously contaminated by user's hands.

It is also an object of the present invention to reduce the packing volume of boxed gloves.

SUMMARY OF THE INVENTION

According to the invention, there is provided a glove packing apparatus for packing gloves into a box, the apparatus comprising a receptacle for forming a stack of said gloves to be packed, the receptacle having:

a perimeter wall for containing said stack of gloves;

a floor within the perimeter wall for supporting said stack of gloves; and an opening opposite the floor into which additional gloves may be added to said stack of gloves;

wherein the floor is movable relative to the perimeter wall, so that, in use:

the floor may be moved relatively away from said opening so that as gloves are added to said stack of gloves, the perimeter wall continues to contain the stack of gloves; and the floor may be moved relatively toward said opening to remove the stack of gloves from the receptacle.

The box may be formed from any suitable material, for example single layer cardboard, stiff paper, or plastic sheet material.

The stack of gloves may be formed manually or automatically, for example by inserting one or more gloves at a time through the opening to build up a stack of gloves supported by the receptacle floor. The perimeter wall can therefore help to define and control the shape of the stack of gloves as this is built up, and ultimately, this will help to ensure that the stack is uniform, with the material of each glove spread out evenly with minimal high spots. Because the floor is moved away from the opening as the stack is built up, the packing operative or packing machine need not reach into the receptacle, but can orient gloves correctly on preceding gloves in the stack, all the while working near the level of the opening to the receptacle. As the stack is built up, the floor is moved away form the opening, so that the working height of the stack continues to be readily accessible but not protruding at any time significantly above the level of the opening. All the while, the perimeter wall continues to stabilise the stack from tipping, while preferably ensuring that the side walls of the stack are, on average straight and parallel with each other.

In a preferred embodiment of the invention, the perimeter wall is fixed and the floor is movable towards and away from the opening. It would, however, alternatively be possible to have the floor fixed, with the perimeter wall being the movable component of the apparatus.

Also in a preferred embodiment of the invention, the floor is an upper surface of a substantially rectangular or square piston that moves within a similarly shaped piston bore.

The receptacle may be inset beneath a surface, for example a worktop that extends around the opening. This can help with the manual sorting and alignment of gloves on the surrounding surface, which can then be easily moved across the surface and into the receptacle. The surface may also help with automatic placement of gloves in the receptacle.

The receptacle will in general have a volume that has a shape that mirrors the internal volume of the box in which the gloves are to be packed. Therefore, it will usually be the case that the perimeter wall extends substantially vertically upwards from the base. The perimeter wall may, however, be discontinuous, as long as this does not adversely affect the containment of the gloves stacked in the receptacle.

In a preferred embodiment of the invention, the perimeter wall has at least one slot, and the apparatus comprises additionally a packing plate adapted to rest on the base of the receptacle. The packing plate is fixed to an extending member that extends through one slot in the perimeter wall. The extending member then can be used to lift or otherwise remove the packing plate from the receptacle when the stack of gloves is complete and ready to be transferred to a box.

To help locate the packing plate correctly on the base, the base may have at least one raised feature in a surface of the base. In a preferred embodiment of the invention, the base has around the perimeter edge, at least one raised feature for locating with one or more corresponding external edges of the packing plate.

Also according to the invention, there is provided a method of packing gloves in a box using a glove packing apparatus, the apparatus comprising a receptacle having an opening and a floor opposite and relatively movable with respect to the opening, the method comprising the steps of:

inserting gloves one or more at a time through the opening and into the receptacle to build a stack of glove that are supported by the floor;

moving the floor as necessary away from the opening so that the stack of gloves is contained by the receptacle;

when the stack of gloves is complete, transferring the stack of gloves into said box.

The transfer of gloves into the box is facilitated by first moving the floor towards the opening to gain more ready access to the stack of gloves and then as gloves are added to stack, moving the floor away from the opening so that the stack of gloves is contained by the receptacle.

The open end of the box in which gloves are to be packed can then be oriented so that this is faces the opening to the receptacle. Optionally, the open end of the box may slot over the outside of the perimeter wall, which can take the form of an extending sleeve. In either case, the receptacle floor can then be moved towards the receptacle opening to move the stack of gloves into the open end of the box.

The box can then be removed from the opening to the receptacle, while at the same time continuing to hold the stack of gloves inside the box. After the box has been removed from the apparatus, the box can be closed, for example by folding flaps over the box opening.

When the apparatus comprises a packing plate that has an extending member, the first step, prior to inserting any gloves through the opening, is to place the packing plate on the movable floor, with the extending member extending externally of the receptacle. Then, when the stack of gloves is ready to be transferred to the box, the extending member can be used to help transfer the stack of gloves into the box. During this process, the packing plate is particularly useful in helping to maintain and compress the gloves fully inside the box.

The open box may have one or more flaps that are moved to close the open end of the box. At least one of these flaps may then be closed while leaving the packing plate in place with respect to said stack of gloves. This helps to compress and contain the gloves in the box until the box can be closed. After at least one flap has been closed, the packing plate can then be removed from the stack of gloves.

In a preferred embodiment of the invention, the apparatus comprises additionally a packing element, the packing element having a lower coefficient of friction than the gloves to be packed. The packing element is then used to cover the packing plate prior to inserting any gloves through the opening, following which the stack of gloves is formed directly on the packing element. The packing element then provides a buffer between the packing plate and the stack of gloves so that the packing plate can slide out of the box without sticking on or dislodging in any way the topmost glove in the stack.

Also described herein is a compression plate for maintaining the alignment of a stack of gloves inside a container, the compression plate comprising a first member and a second member, and a biasing means, said members being joined at a first fold line between said members, wherein: the first member has a second fold line that divides the first member in a first segment and a second segment; —each of said segments is pulled together by the biasing means so that said segments have a tendency to flex along the second fold line and away from the second member.

The first and second members may have corresponding cut outs in the vicinity of the first fold line, said cut outs at (east partially overlapping to permit, in use, gloves to the dispensed through the cut outs.

The biasing means, which may be an elastic band, may engage with engagement features in both the first and second segments of the first member, for example being provided in side edges of the first and second segments.

The first and/or second members are preferably formed from sheet material, for example cardboard, stiff paper or plastic sheet material.

BRIEF DESCRIPTION OF THE DRAWINGS

The invention will now be further described, by way of example only, and with reference to the accompanying drawings, in which.

DETAILED DESCRIPTION

Figure 1:
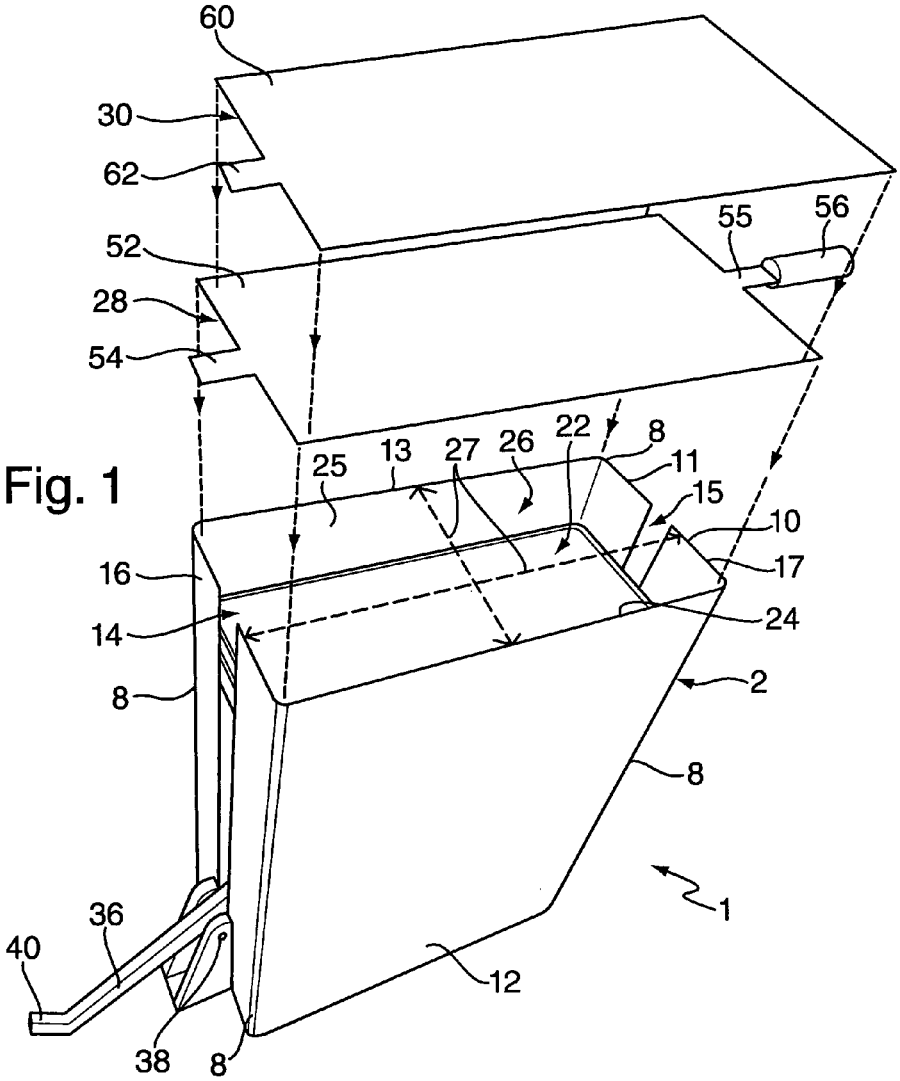
FIG. 1 shows in perspective a view from above and to one side of a glove packing apparatus according to a first preferred embodiment of the invention, having a packing sleeve having an internal perimeter wall surface and a movable base which together form a packing receptacle, and a packing plate and a packing element that inserts into the packing receptacle.

FIG. 1 shows a first embodiment of a glove packing apparatus 1, having a packing sleeve 2, a packing plate 28 and a packing element 30. The packing sleeve 2 extends vertically and has a rectangular horizontal cross-section with rounded corners 8. The sleeve is formed in two halves 10, 11, each of which has the same shape, being formed from folded sheet metal, preferably stainless steel. Each sleeve half 10, 11 has a square C-shape in a horizontal cross-section and extends fully on long sides 12, 13 of the packing sleeve 2. The sleeve halves 10, 11 are separated by a vertically extending gap 14, 15 along the centre of short sides 16, 17 of the sleeve 2.

Figure 3:
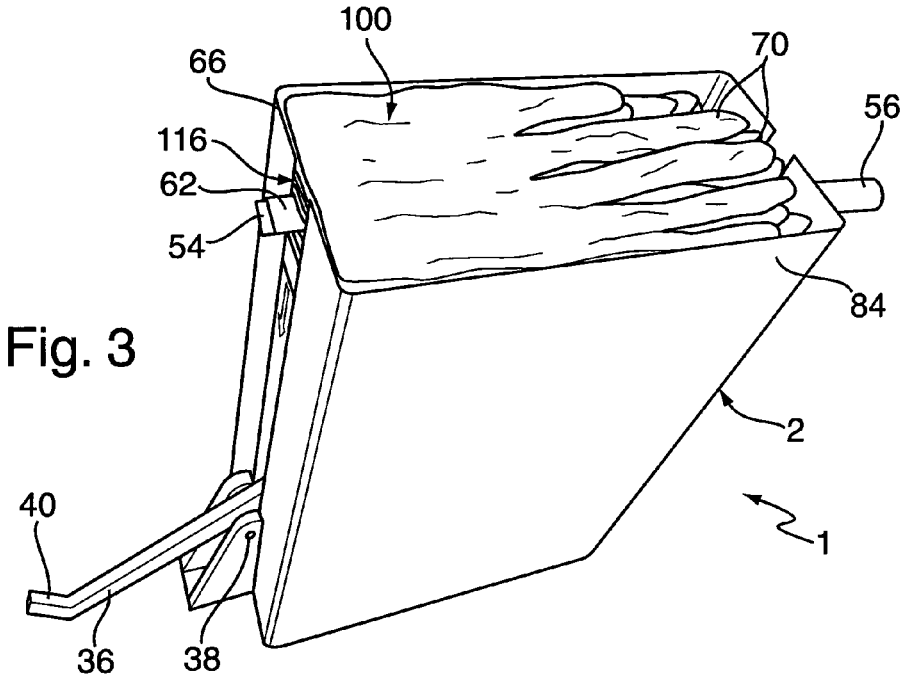
FIG. 3 shows the packing apparatus of FIG. 1 when the packing receptacle is packed full with a stack of gloves.

The packing sleeve 2 contains a movable base 20 that provides a floor surface 22. The floor 22 and internal wall surfaces 24, 25 provided by the sleeve halves 10, 11 define a packing receptacle 26 for receiving a stack of gloves 100 to be packed by the apparatus 1, as shown in FIG. 3. The internal wall surfaces 24, 25 therefore extend around the periphery of the packing receptacle 26, which has an opening 27 also bounded by the perimeter wall surfaces 24, 25.

The apparatus preferably includes a steel packing plate 28 and a non-woven fabric packing element 30 that are first inserted into the packing receptacle 26. The function of these will be described below.

Figure 2:
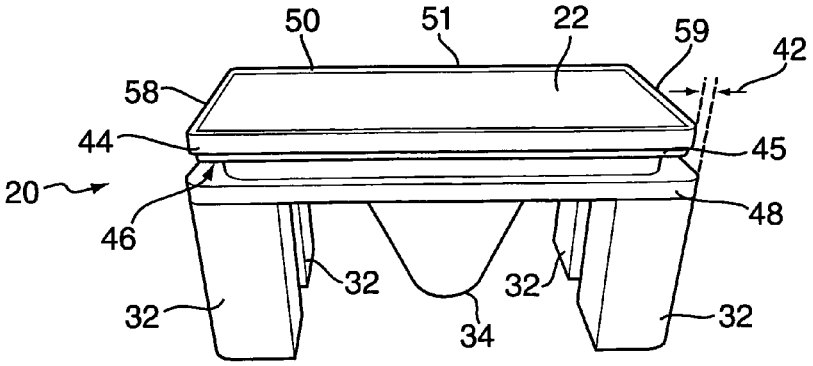
FIG. 2 shows in perspective a view from above and to one side of the movable base of FIG. 1.

The base 20 is shown in more detail in FIG. 2. The base is preferably formed as a unitary plastic moulding and has four downwardly extending legs 32 that are shaped to make a close sliding fit with the interior wall surfaces 24, 25 in the vicinity of the sleeve corners 8. Between the legs is a fulcrum 34 which is connected to one end of a lever arm 36. The lever extends from the fulcrum 34 though a first one 14 of the slots in the perimeter wall 24, 25 another end of which can be seen in FIG. 1. The lever 36, which is manually operated, pivots about a pivot 38 fixed externally of the sleeve halves 10, 11. When a lever handle 40 at the end of the lever arm 36 is moved up and down, the base 20 then moves correspondingly down and up.

The floor 22 of the base 20 has the same rectangular shape as the sleeve cross-section, but is smaller in both length and width to provide a clear gap 42 between base 20 and the perimeter wall 24, 25. The gap is defined by a rectangular strip 44 that extends downwardly from the floor 22 of the base 20. A lower edge 45 of the strip terminates at an under hanging surface 46 such that the dimension of the gap 42 is increased beneath the strip lower edge 45. The base floor 22 proximate the perimeter edge 51 therefore extends above an overhang feature 44, 45 46 in the base 20.

At a distance beneath the strip lower edge 45 at least equal to the width of the rectangular strip 44, the base has a rectangular platform 48 with a rectangular outer profile that matches the shape of the perimeter wall surfaces 24, 25 so that the base platform makes a close sliding fit with these perimeter wall surfaces. The legs 32 and fulcrum 34 then extend downwardly from the base platform 48. The contact between the base platform 48 and legs 32, on the one hand, and the perimeter wall 24, 25 on the other hand, guides the vertical movement between the base 20 and the perimeter wall.

As will be described below, it has been found that this arrangement, in which the floor 22 which is used to support gloves is stepped upwards and inwards with respect to that part of the base which makes a sliding fit of the base 20 within the sleeve 2, greatly reduces or eliminates the chances that any of the supported gloves will become caught or trapped between the movable base 20 and the perimeter wall 24, 25 of the sleeve 2.

The base floor 22 has a raised rim 50 substantially fully around an outer perimeter edge 51 of the floor. The rim is sized so that a main rectangular portion 52 of the packing plate 28 is located within the rim 50 when the packing plate is brought to bear against the base floor 22. The packing plate 28 has at one end of the central rectangular portion 52 a forwards extending tab 54, and at an opposite end a rearwards extending projection 55 with a handle 56 by which the packing plate may more easily be gripped and moved by hand. Both projections 54, 55 make a close sliding fit with the sleeve apertures 14, 15 when the packing place is first inserted into the packing receptacle 26, so that the packing plate is guided into location with the rim 50 of the base floor 22. The rim 50 has a pair of gaps 58, 59 that accommodate the packing plate projections 54, 55 so that the central rectangular portion 52 of the packing plate sits flush against the base floor 22.

Prior to inserting any gloves into the packing recess 26 the packing element 30 is placed directly on the central rectangular portion 52 of the packing plate 28. The packing element is a non-woven fabric or paper slip that has a main rectangular portion 60 the size of which matches that of the packing element rectangular portion 52, and also has a forwards extending tab 62 which covers over the forwards tab 54 of the packing plate 28.

FIGS. 3 to 9 illustrate how the apparatus may be used to efficiently pack a box 64 with disposable medical gloves 70. The box 64 may be formed from any suitable sheet-like material, for example, single layer cardboard, stiff paper, or plastic sheet material, but in this example is cardboard. After inserting the packing plate 28 and packing element 30 into the packing receptacle 26, either before or after moving the base 20 to a location a short distance beneath an upper edge 66 of the packing sleeve 2, gloves are aligned by hand and inserted into the receptacle 26, a lowermost glove 70 rests directly on the packing element 30. The base floor 22 should ideally be set at a level so that the most recently packed gloves are beneath but near the sleeve upper edge 66 so that the stack of gloves 100 is at all times contained and aligned by the interior wall surfaces 24, 25 of the packing sleeve 2.

The apparatus preferably contains a stop mechanism (not shown) by which the downwards movement of the base 20 is set to a limit which corresponds to a desired vertical size of stack of gloves. When this is achieved, the stack of gloves 100 is ready for transfer into the cardboard box 64, shown in most detail in FIG. 4. The box 64 is rectangular in a horizontal cross-section, and has a height which is equal to or less than its width. The box 64 has four flaps 71, 72, 73, 74 at the top edges of four corresponding sides 75, 76, 77, 78 of the box. The flaps are initially splayed outwards around a packing box opening 65.

The box 64 is first inserted into a box-like holder or carrier 80 which has an interior volume 79 that matches the shape of the packing box 64. The packing box carrier 80 has a substantially rectangular opening 82 that leads to a box-like receptacle 83 which receives and provides mechanical support to the packing box 64 during the packing process.

Figure 5:
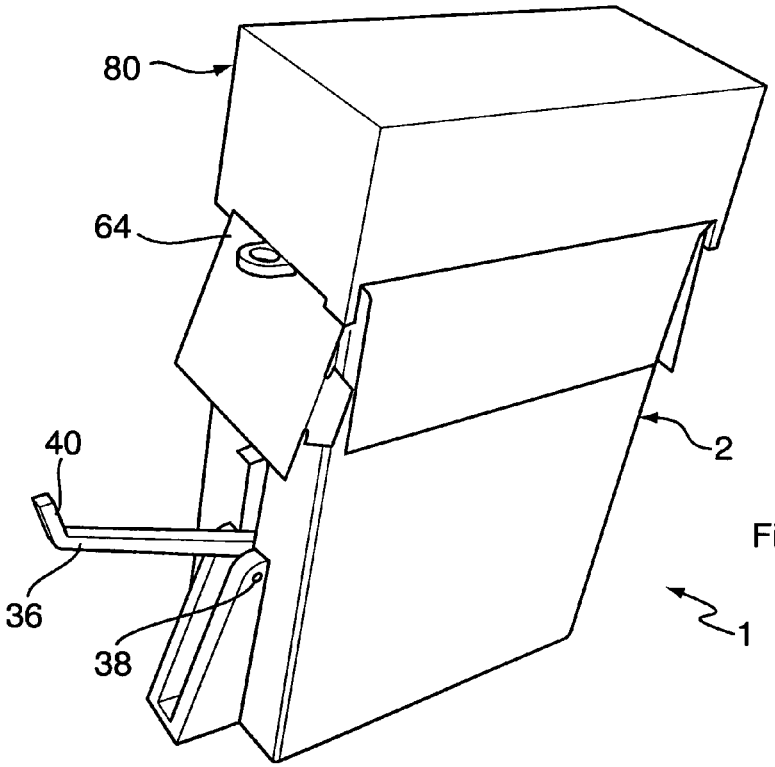
FIG. 5 shows the packing apparatus of FIG. 3 when the box-like receptacle is placed over the open end of the packing sleeve.

When the packing box 64 is seated in the packing box carrier 80, with the box flaps 71-74 splayed outwards, the packing box opening 65 is brought up against the upper edge 66 of the packing sleeve 2, so that the extending outer surface 84 of the packing sleeve nearest the upper edge 66 (see FIG. 3) can slot into the packing box opening 65, as shown in FIG. 5.

The lever arm 36 is then use to raise the base 20 and press the stack of gloves 100 up against the inside base of the packing box 64. As air is expelled from the stack of gloves 100, the front and rear packing plate projections 54, 55 come in to proximity with a pair of corresponding magnets 90, 91 situated on forwards and rearwards projection tabs 92, 93 that extend outwards in opposite directions from upper central portions of front and rear walls 94, 95 of the packing box carrier 80. As these projecting portions of the packing plate 28 are formed from steel, the packing plate becomes magnetically clamped to the packing box carrier.

During the upward motion of the stack of gloves 100, outer edges of the stack may drag against the perimeter walls 24, 25 and so be deflected downwards. An important feature of the invention is that the lowermost gloves on the stack are prevented from interfering with or becoming caught between the sliding base 20 and sleeve 2 by the clear gap 42 and overhang 46 above the sliding contact of the base platform 48 and perimeter walls 24, 25.

The packing operator can then lift the boxed gloves and surrounding assembly using the packing plate handle, and then invert this magnetically clamped assembly and place on a nearby working surface, as illustrated in FIGS. 6 to 9.

Figure 7:
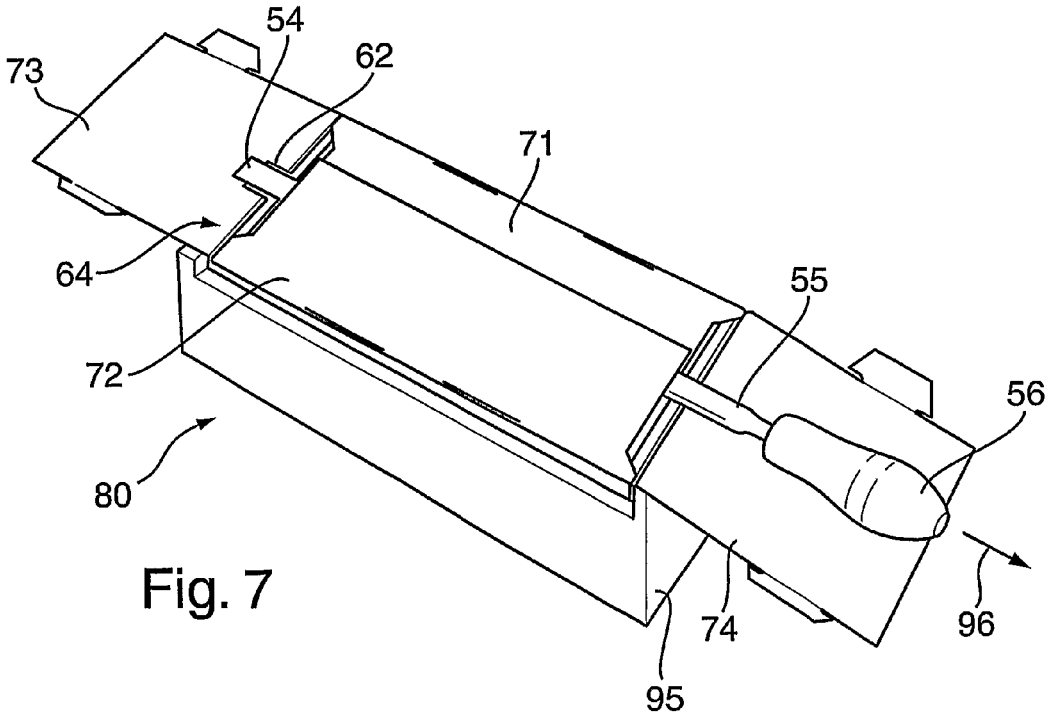
FIG. 7 shows how two side flaps of the packing box are first folded over the packing plate.
Figure 8:
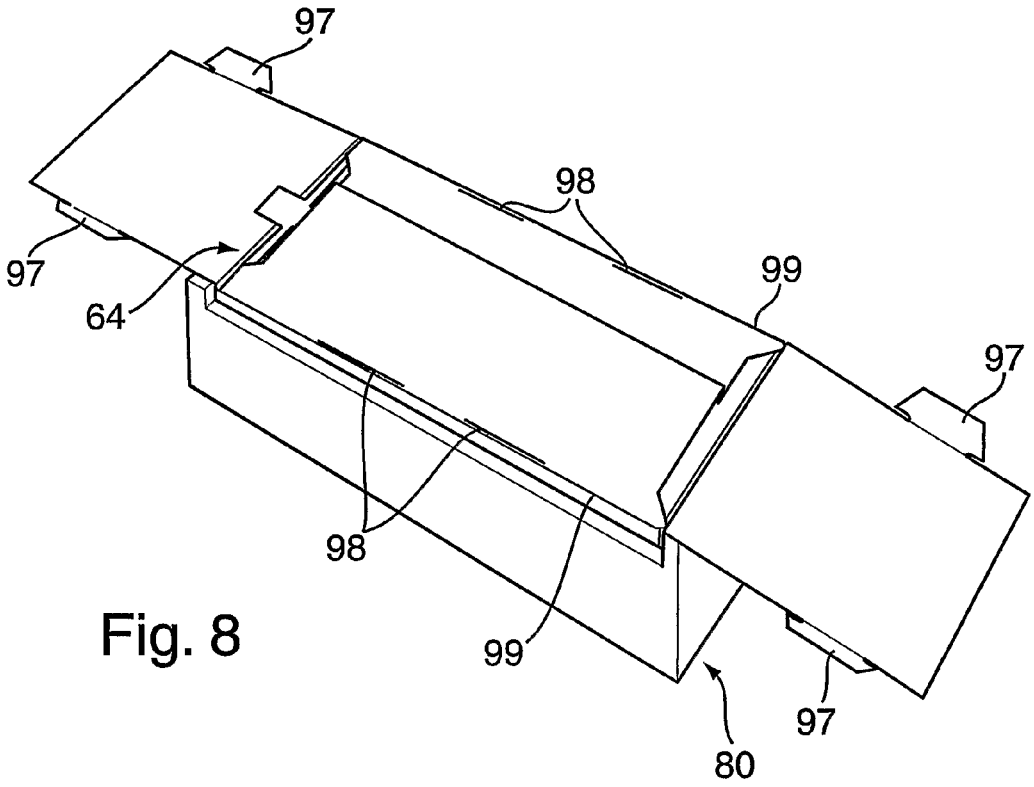
FIG. 8 shows how the packing plate is removed from the box, with the packing element left in place inside the box.

The first step in closing the box is to fold inwards the pair of flaps 71, 72 on the long sides 75, 76 of the packing box 64, as shown in FIG. 7. Then, while holding these closed flaps 71, 72 in place, the packing plate handle 56 can be used to slide 96 the packing plate 28 horizontally away from the packing box carrier 80 and so disengage the magnetic clamp with the pair of magnets 90, 91.

The presence of the packing element 30 helps to isolate the sliding movement 96 of the packing plate 28 from the topmost glove 70 so that the stack of gloves 100 is in no way disrupted by the withdrawal of the packing plate.

Figure 9:
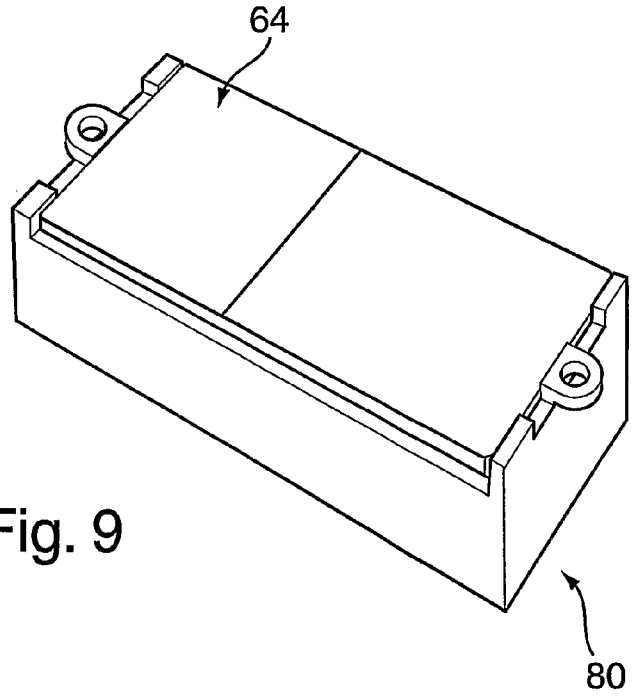
FIG. 9 shows how two end flaps are folded over the side flaps to close the box fully.

The packing element 30 is preferably then left in place while the remaining two end flaps 73, 74 are folded inwards. The end flaps 73, 74 each have a pair of side tabs 97 which engage with corresponding side slots 98 at a fold line 99 between the side flaps 71, 72 and the corresponding side panels 75, 76 of the packing box 64 when closed, as shown in FIG. 9. The filled packing box 64 may then be removed from the packing box carrier 80.

It should be noted that gloves being packed could be folded in half, with cuffs facing the same way, or interfolded in half with cuffs facing in alternate directions. The interior dimensions of the sleeve 2 and packing box can be set accordingly, depending on the desired width and length of the stack of gloves, so that the packed gloves fit snugly within the packing box with minimal wasted packing volume.

Figure 10:
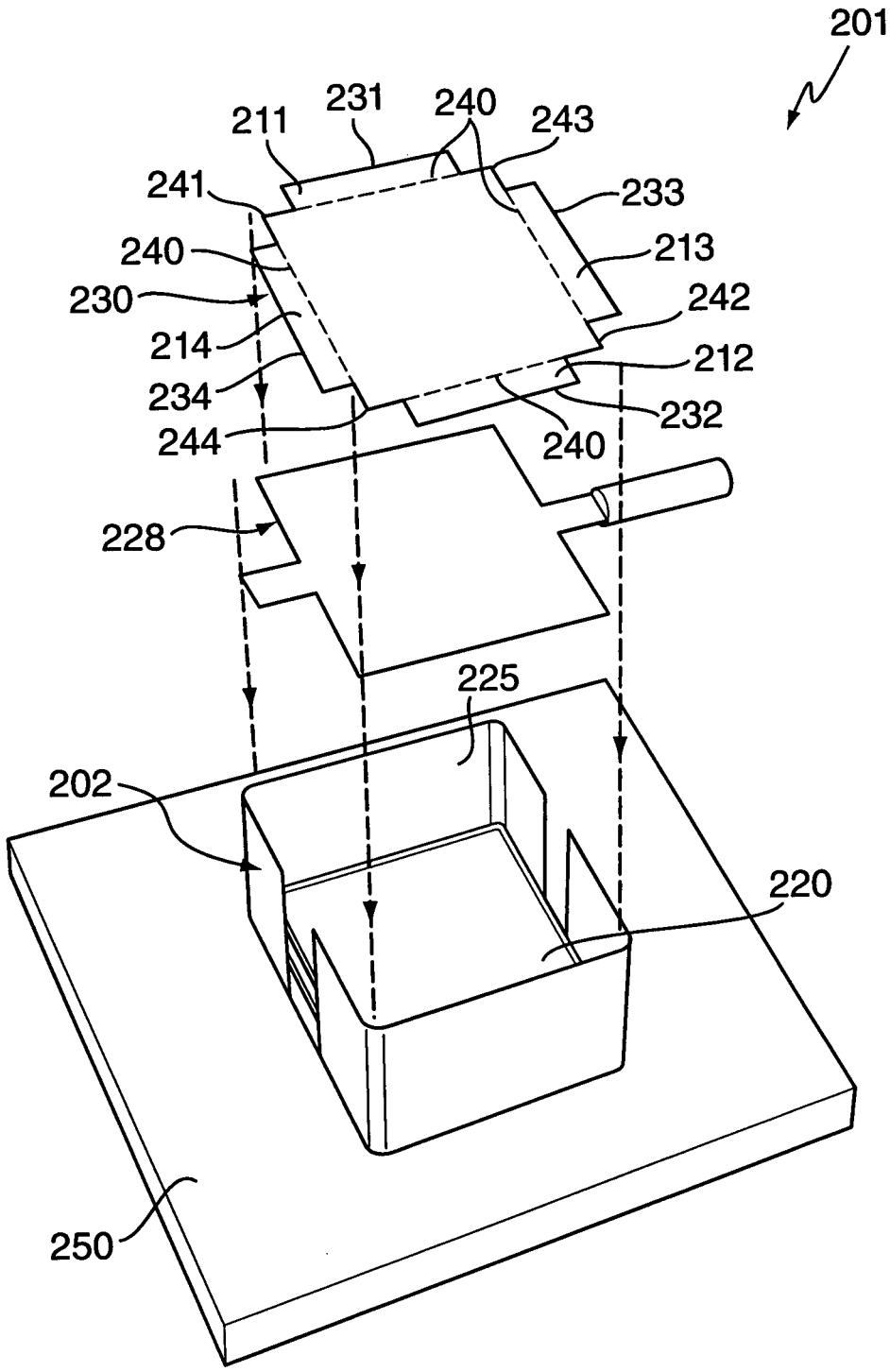
FIG. 10 shows in perspective a view from above and to one side of a glove packing apparatus according to a second preferred embodiment of the invention, having a square packing sleeve partially set into a surrounding work surface.

FIG. 10 therefore shows in perspective a view from above and to one side of a glove packing apparatus 201 according to a second preferred embodiment of the invention. This differs from the first embodiment 1 in that the packing sleeve 202 and packing plate 228 all have a generally square outline for packing a similarly square box full of gloves. The packing element 230, which is again formed from a slip of paper having a lower coefficient of friction than the gloves to be packed. The packing element 230 differs in having a substantially square outline, but with four similar tabs 211-214 extending from each side 231-234 of the packing slip, except in the vicinity of the four corners 241-244 of the paper slip 230.

Figure 11:
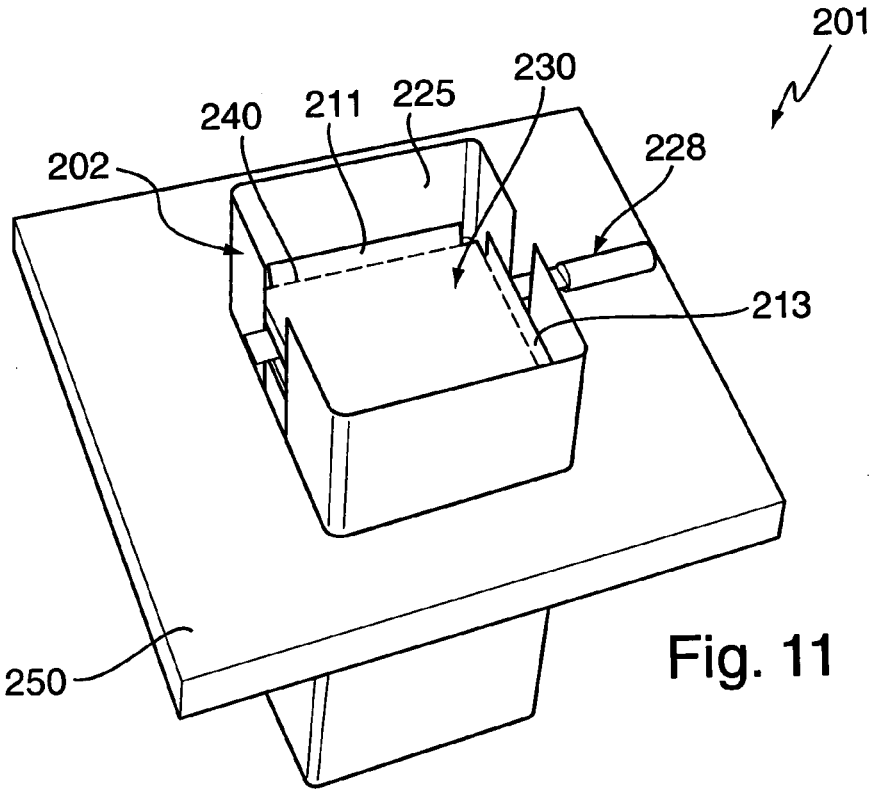
FIG. 11 shows the glove packing apparatus of FIG. 10, after a packing plate and a packing element have been inserted into the packing receptacle, with tabs of the packing element rising up the walls of the receptacle.

As shown in FIG. 11, when the packing slip 230 is inserted into the packing sleeve 202, the tabs ride up interior walls 225 of the sleeve. To aid this, the tabs may be defined by a fold lines, indicated schematically by dashed lines 240, each of which extends between adjacent corners 241-244 of the slip. This covers over most of the gap between the walls 225 and the packing plate 228 or the floor 222 of the movable base 220, in order to prevent portions of gloves from becoming trapped in this gap when the floor 220 is raised in order to pack the gloves into a box, as described above.

The packing sleeve 202 is surrounded and partially set into a work surface 250, at a level where the packing plate 228 rests on the work surface as the packing sleeve is filled by hand or by machine with gloves.

Figure 12:
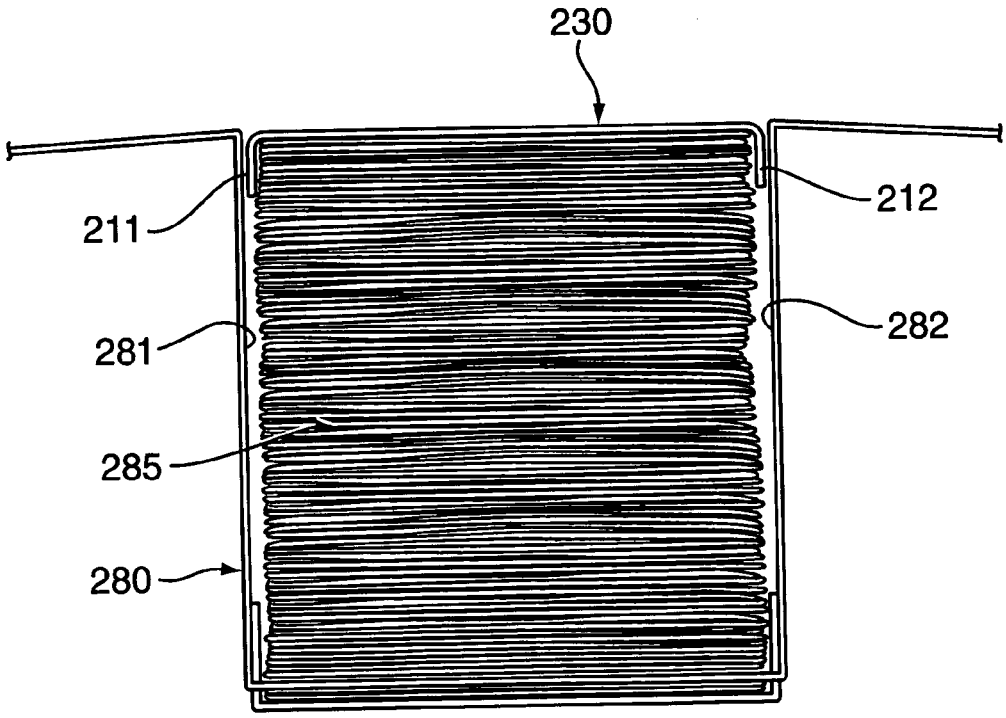
FIG. 12 shows how the packing element remains in a box packed full of gloves.

The use of the packing plate 228 is similar to that described above. In this embodiment, however, the packing slip 230 is intended to remain in the packed box 280, as shown in FIG. 12, where two of the four tabs 211, 212 are shown curved inwards down interior surfaces 281, 282 of the box 280. During packing of the box, the packing slip 230 therefore also provides some protection to a stack of gloves 285 within the box, by wrapping substantially over the stack of gloves.

The square outline box of FIG. 12 has a width of 120 mm, a depth of 130 mm and a height of between 100 mm and 140 mm. In this example the height is 130 mm. The particular width, depth and height will, of course depend on a number of factors, such as the length of the gloves from finger tip to cuff, the thickness of the glove material, and the number of gloves to be packed inside each box.

The gloves in such a square outline arrangement will be over-folded, with the fingers of each glove being folded around the cuff of the preceding glove in the stack, relative to the order of dispensing from the stack. Although not illustrated, this arrangement lends itself to cuff-first dispensing from a dispensing aperture in the box 280, on an opposite side to that having the packing slip, with each glove pulled cuff-first from the dispensing aperture serving to pull the cuff of the next glove to be dispensed out of the dispensing aperture. In this way, each glove to be dispensed can be pulled cuff first from the dispensing aperture without having the user touching the finger portion of each dispensed glove.

Figure 13:
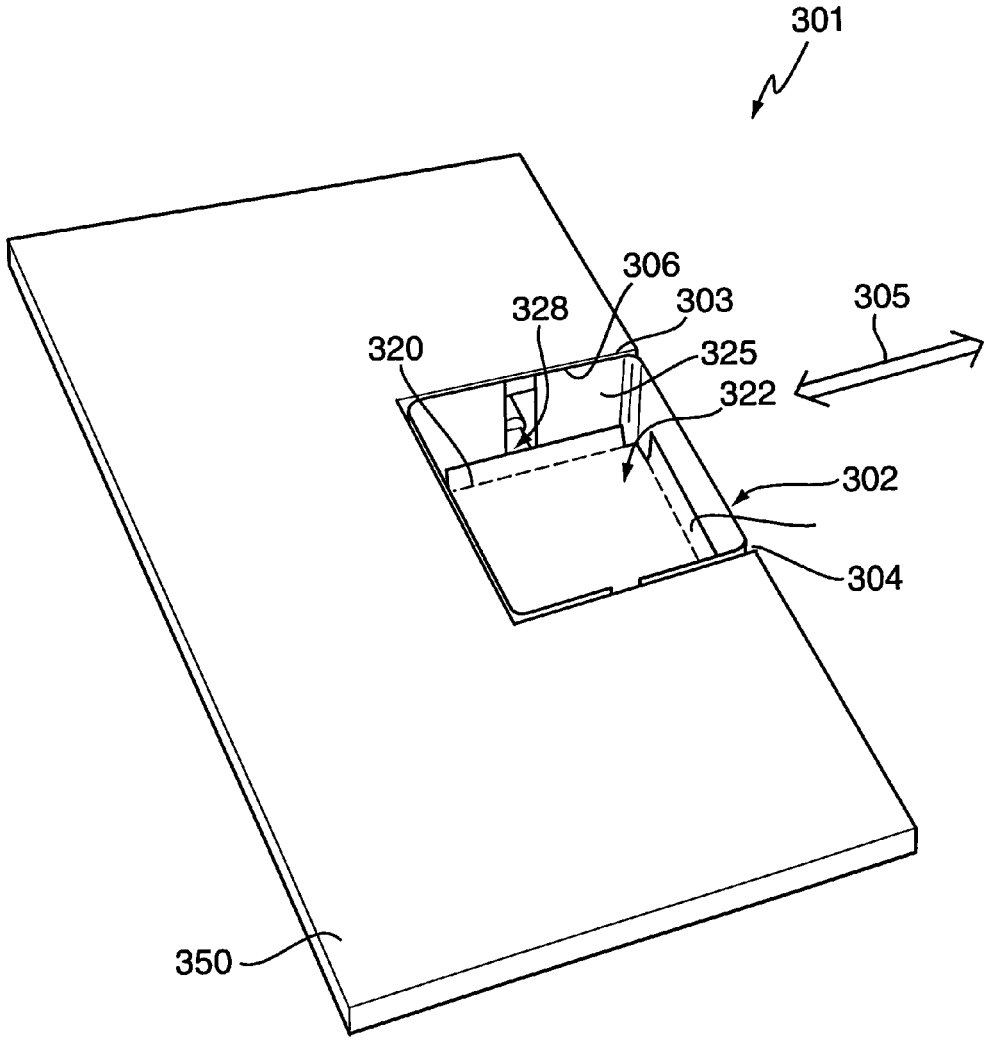
FIG. 13 shows in perspective a view from above and to one side of a glove packing apparatus according to a third preferred embodiment of the invention, having a square packing sleeve that is slotted flush into a work surface.

FIG. 13 shows a glove packing apparatus according 301 to a third preferred embodiment of the invention, similar to that of the second embodiment 201, but having a square packing sleeve 302 that is slotted into a square recess 303 in a work surface 350. The recess 303 is open at one side 304 so that the packing sleeve 302 can be moved in and out of the recess 303 as indicated by an arrow labelled 305.

The work surface 350 may be supported at a convenient height for a worker by legs or other supports (not shown) and is therefore preferably fixed in place. The packing sleeve 302 is mobile, being mounted, for example, on a wheeled undercarriage (not shown) so that a worker can move the packing sleeve about as desired.

The packing sleeve has a top edge 306 that is the same height as that of the work surface 305. A worker may then gather and fold gloves (not shown) that have been piled on the work surface around the packing sleeve, and then lift or slide these gloves one at a time into the packing sleeve, building up a stack of interfolded gloves above a floor surface 322 of a movable floor 320 within the packing sleeve. Initially, the floor surface is close to but recessed just below the level of the packing sleeve top edge 306. As the stack of glove is built up, the worker lowers the floor surface 322 so that the top of the stack of gloves does not extend above the level of the packing sleeve top edge 306. In this ways, the gloves are aligned vertically by interior walls 325 of the sleeve as the stack is built up.

When sufficient gloves have been inserted into the packing sleeve 302, this is moved out of the recess 303 to a separate work station (not shown), where an empty box 280 in placed over the exposed top end of the packing sleeve, prior to compression of the gloves into the box by the movable floor 320, with the aid of a packing plate 328, followed by closing and sealing of the box as described above.

The reason that the packing process may be conveniently split into two separate stages at different work stations is that it is considerably quicker to pack the box with the stack of gloves than it is to fill the recess within the packing sleeve with a stack of interfolded gloves. Therefore, in a manual packing operation there may be several workers at different work stations responsible for filing packing sleeves with a stack of gloves for every one worker responsible for filling boxes with stacked gloves.

The division of such process steps in a production line having a mobile packing sleeve will also be suited to machine automation, in which a robotics system with computer vision is used to fold and pack gloves into the sleeve, prior to packing boxes with stacks of gloves contained in packing sleeves by a dedicated machine at a separate box packing station. In an automated system, gloves may be brought to the sleeve packing station by a conveyor belt. A glove flipper may be used in conjunction with the conveyor belt to orientate each glove correctly so that a robot arm can pick up each glove and deposit in the sleeve with the cuff and fingers correctly oriented. In such an automated system, the second stage of packing the boxes may be done manually with there being two or more automated sleeve packing stations for each manual box packing station.

Figure 14:
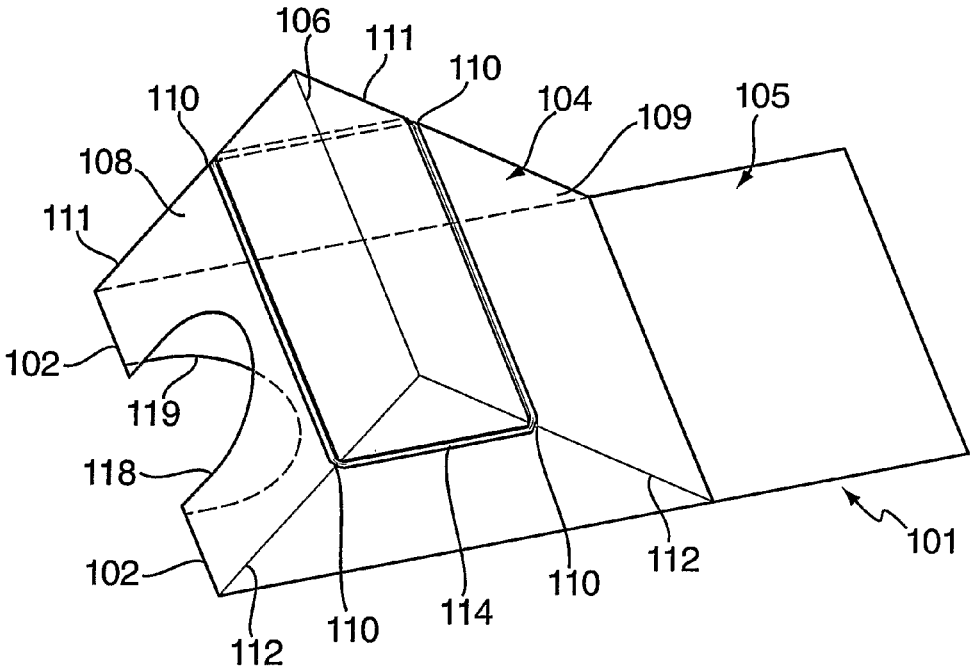
FIG. 14 shows in perspective a view from above and to one side of a compression plate for maintaining compression of the stack of gloves within the box.
Figure 15:
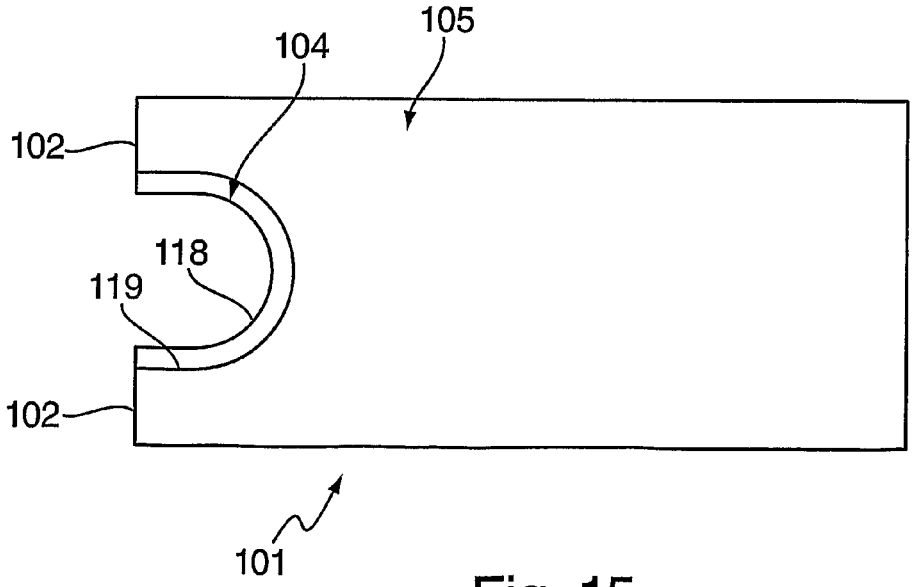
FIG. 15 shows a view from beneath of the compression plate of FIG. 14.

FIGS. 14 and 15 show a generally rectangular compression plate 101 which is inserted in the packing box 64 prior to filling the box with the stack of gloves 100. The compression plate 101 is formed from an elongate strip of cardboard material that has a primary transverse fold line 102 where the plate is folded back on itself so that the compression plate has an elongate upper member 104 and an elongate lower member 105. Another transverse fold line 106 crosses the upper member 104 midway along the length of this member, thereby dividing the upper member into the forwards segment 108, and a rearwards segment 109, each having an equal length in a direction along the length of the compression plate 101.

The forwards and rearwards segments 108, 109 each have at a portion of each segment closest to the fold line 106 in the upper member 104 a pair of notches 110 in side edges 111, 112 of the card material forming the upper member 104. An elastic band 114 is engaged with each notch 110, and when the upper member 104 is lying flat against the lower member 105, the elastic band is stretched so that the forwards and rearwards segments 108, 109 are being pulled together. The fold line 106 in the upper member 104 forms a hinge between the forwards and rearwards segments 108, 109.

Figure 4:
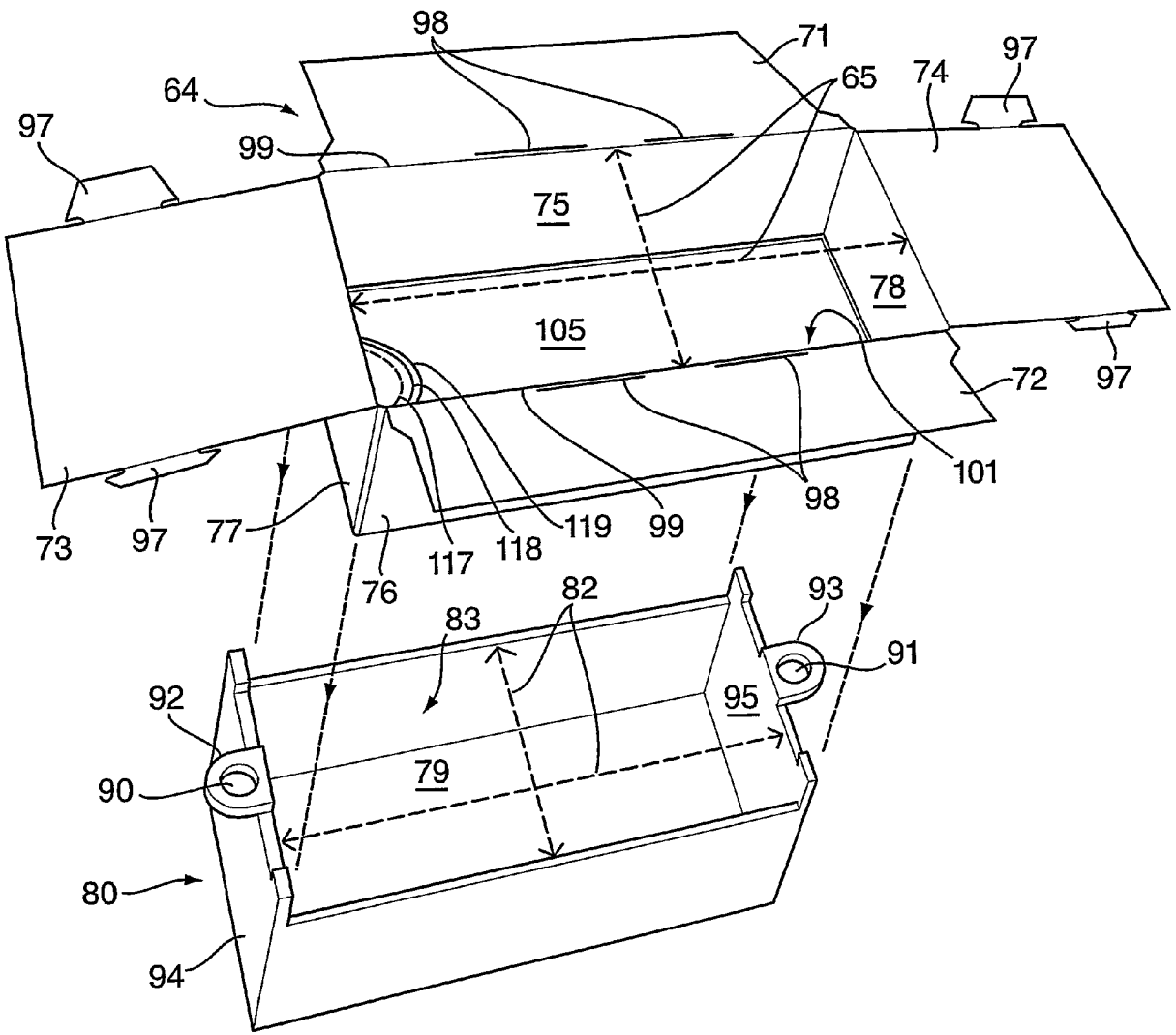
FIG. 4 shows a box-like receptacle for receiving a packing box into which the stack of gloves is to be packed
Figure 6:
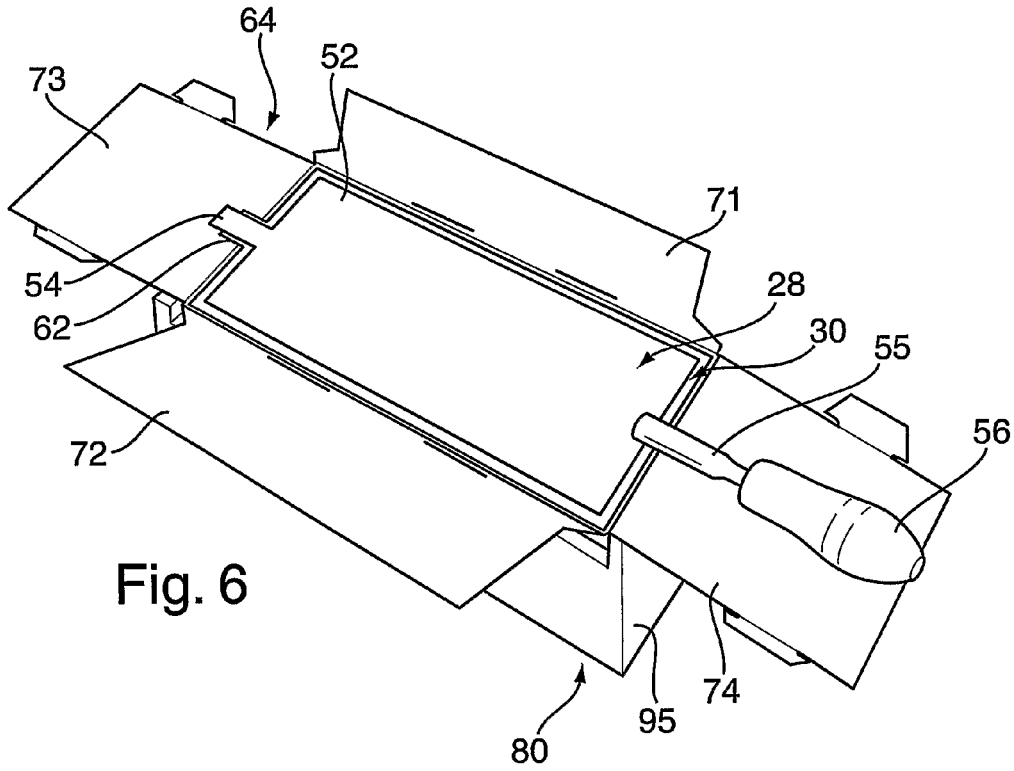
FIG. 6 shows the packing box when removed from the packing sleeve, and with the packing plate and packing element being used to maintain the stack of gloves under compression inside the box.

As shown in FIG. 4, the compression plate is inserted into the open packing box 64 with the lower member 105 facing towards the box opening 65. The box flaps 71-74 when closed form a base to the packing box when ready for use, the opposite side of the box having a semicircular tear away patch 117 which is removed prior to use in order to gain access to a cuff end 116 of the stack of gloves 100, so that gloves 70 may be dispensed cuff first from the packing box 64.

The compression plate has in both the upper and lower members 104, 105 similarly shaped, but larger semicircular cut outs 118, 119. The cut out 119 in the lower member 105 is larger than the cut out 118 in the upper member 104, which is larger than the tear away opening 117 in the packing box 64.

When a user opens the packing box 64 and begins to pull gloves 70 cuff first from the opening, the use may touch with his or her fingers the opening 117 in the box. The cut outs 118, 119 below, however, will be protected from potential contamination from a user by the box opening 117 which overhangs the cut outs below.

As gloves are dispensed, space opens up in the box. The elastic band 114 is under tension and able to flex the segments 108, 109 of the upper member 104 about the fold line 106 which therefore acts as a hinge to permit the elastic band to flex the upper member segments into a V-shape, as shown in FIG. 13. The fold line 106 forms an apex to this V-shape and bears against top inner surface of the packing box 64, thereby pressing the lower member 105 of the compression plate 101 against the top of the remaining stack of gloves inside the box. As gloves are removed, the upper member segments continue to flex, thereby maintaining contact between the top of the stack of gloves and the upper member 105. In this way, the alignment of the stack of gloves within the box is maintained. This is important because the cuffs of the gloves 70 need to be near the box opening 117 to ensure reliable dispensing cuff first. Because users can pull out gloves by the cuffs, user contact with external surfaces of the gloves used in examination is prevented, thereby reducing the risk that microorganisms or other forms of contamination may be spread by use of the gloves.

As gloves are dispensed, the potential for contamination of the gloves is also reduced owing the overhanging box opening 117 and upper plate cut out 118, as these both protect the lower plate cut out 119, which remains in contact with the topmost glove in the stack of gloves, from any contamination.

The invention therefore provides a convenient way of packing gloves in a box container, and also an effective way of maintaining cleanliness during the dispensing of gloves.

The invention claimed is:

1. A glove packing apparatus for packing gloves into a container from which gloves may be dispensed, the apparatus comprising:

a receptacle and a stack of gloves held by the receptacle for packing into said container, the stack having a bottom, four side walls and a top and the receptacle having:

a perimeter wall, the perimeter wall having surfaces and said surfaces being configured to contain said plurality of sides of the stack of gloves, said surfaces of the perimeter wall are configured to define the shape of the four side walls of said stack as gloves are added to said stack of gloves whereby said stack is substantially rectangular or square in outline around said four side walls of the stack;

a floor within the perimeter wall for supporting said stack of gloves, the floor being provided by a base of the receptacle and wherein the perimeter wall extends substantially vertically upwards from said base;

an opening opposite the floor into which additional gloves may be added to the top of said stack of gloves;

wherein the floor and the perimeter wall are relatively movable with respect to each other in opposite substantially vertical directions, so that, in use:

the floor may be moved relatively away from said opening so that as gloves are added to said stack of gloves, the perimeter wall continues to contain the stack of gloves; and the floor may be moved relatively toward said opening to remove the stack of gloves from the receptacle.

2. A glove packing apparatus as claimed in claim 1, in which the perimeter wall is fixed and the floor is movable towards and away from the opening.

3. A glove packing apparatus as claimed in claim 2, in which said base of the receptacle is movable by means of a lever arm, whereby the floor is movable towards and away from the opening.

4. A glove packing apparatus as claimed in claim 3, in which the lever arm extends through a slot in the perimeter wall.

5. A glove packing apparatus as claimed in claim 1, in which the opening is bounded by the perimeter wall.

6. A glove packing apparatus as claimed in claim 1, in which the receptacle is inset with a surface that extends around the opening.

7. A glove packing apparatus as claimed in claim 1, in which the perimeter wall is discontinuous.

8. A glove packing apparatus as claimed in claim 7, in which the perimeter wall has at least one slot, and the apparatus comprises additionally a packing plate, the packing plate being beneath the stack of gloves and above the floor, whereby the packing plate supports said stack of gloves and rests on said base of the receptacle so that the packing plate follows the movement of the floor relatively away from said opening as additional gloves are added to the top of said stack of gloves, the packing plate having an extending member that extends through the at least one slot in the perimeter wall and by which the packing plate may, in use, be removed from the receptacle through the opening, to aid removal of the stack of gloves from the receptacle.

9. A glove packing apparatus as claimed in claim 8, in which said base of the receptacle has a floor surface, the floor surface having at least one raised feature for locating the packing plate with respect to said base of the receptacle.

10. A glove packing apparatus as claimed in claim 8, further comprising a packing element for inserting between the packing plate and said stack of gloves, in which said packing element has tabs that substantially cover a gap between the floor and adjacent walls of the receptacle.

11. A glove packing apparatus as claimed in claim 1, in which the perimeter wall proximate the opening is an inner surface of an extending sleeve adapted to fit into a container in which gloves are to be packed.

12. A glove packing apparatus as claimed in claim 1, further comprising a box-like receptacle for receiving a container into which said stack of gloves is to be packed, the box-like receptacle having an opening into which said container may be inserted, and interior walls for holding a packing box once inserted into the opening.

13. A method of packing gloves into a container using a glove packing apparatus, the apparatus comprising a substantially vertically oriented receptacle having an upwards facing opening and a floor opposite said opening, the floor and opening being relatively movable in a substantially vertical direction with respect to each other, the method comprising the steps of:

inserting gloves one or more at a time through the opening and into the receptacle to build a stack of gloves that is supported by the floor;

relatively moving as necessary the floor and the opening with respect to each other in said substantially vertical direction so that the floor moves relatively away from the opening so that the stack of gloves is contained by the receptacle; and when the stack of gloves is complete, transferring the stack of gloves into said container.

14. A method as claimed in claim 13, in which the building of said stack of gloves is facilitated by first relatively moving the floor and the opening with respect to each other so that the floor moves relatively towards the opening to gain more ready access to the stack of gloves and then as gloves are added to said stack of gloves, relatively moving the floor and the opening with respect to each other in said substantially vertical direction so that the floor moves relatively away from the opening and so that the stack of gloves is contained by the receptacle.

15. A method as claimed in claim 13, comprising the steps of orienting an open end of said container over the opening to the receptacle and then relatively moving the floor and the opening with respect to each other so that the floor moves relatively towards the opening to move the stack of gloves through said open end into the container.

16. A method as claimed in claim 15, comprising the step of removing the container with the stack of gloves from the opening to the receptacle, and closing the open end of the container.

17. A method as claimed in claim 13, the apparatus further comprising a packing plate, the packing plate having an extending member, the method comprising the steps of:

prior to inserting of any gloves through the opening, placing the packing plate on the floor, with the extending member extending externally of the receptacle; and when the stack of gloves is ready to be transferred to said container, using the extending member to help transfer said stack of gloves into said container.

18. A method as claimed in claim 17, in which the container has one or more flaps that are moved to close the open end of the container, the method comprising the steps of:

closing at least one flap while leaving the packing plate in place with respect to said stack of gloves; and after said at least one flap has been closed, removing the packing plate from the stack of gloves.

19. A method as claimed in claim 18, in which the apparatus further comprises a packing element, the packing element having a lower coefficient of friction than the gloves to be packed, the method comprising the step of using said packing element to cover the packing plate prior to inserting of any gloves through the opening, and then inserting gloves one or more at a time through the opening and into the receptacle to build a stack of gloves that rests on the packing element.

20. A method as claimed in claim 18, in which the apparatus further comprises a packing element, the method comprising the step of using said packing element to cover the packing plate prior to inserting of any gloves through the opening, and then inserting gloves one or more at a time through the opening and into the receptacle to build a stack of gloves that rests on the packing element, the packing element covering the floor and a gap between the floor and adjacent walls to prevent gloves from becoming trapped between the floor and adjacent walls.

21. A method as claimed in claim 13, in which the method comprises, as the floor is moved relatively towards the opening, the step of pressing the stack of gloves up against an inside base of a box-like receptacle to expel air from the stack of gloves and thereby reduce the volume of the stack of gloves.

22. A method of packing gloves in a container using a glove packing apparatus, the apparatus comprising a receptacle having an opening and a floor opposite said opening, the floor and opening being relatively movable with respect to each other, the method comprising the steps of:

inserting gloves one or more at a time through the opening and into the receptacle to build a stack of gloves that is supported by the floor;

relatively moving as necessary the floor and the opening with respect to each other so that the floor moves relatively away from the opening and so that the stack of gloves is contained by the receptacle;

when the stack of gloves is complete, relatively moving the floor and the opening with respect to each other so that the floor moves relatively toward the opening in order to remove the stack of gloves from the receptacle; and transferring the stack of gloves into said container.

23. A glove packing apparatus for packing gloves into a container, the apparatus comprising:

a receptacle, and a stack of gloves held by the receptacle for packing into a container, the stack of gloves having a bottom, a top and four sides between said bottom and said top, and the receptacle having:

a perimeter wall, the perimeter wall having surfaces and said surfaces being configured to contain said sides of the stack of gloves;

a floor within the perimeter wall, the floor being provided by a base of the receptacle, said base of the receptacle having a floor configured to support the stack of gloves and the floor having a perimeter edge; and an opening opposite the floor into which additional gloves may be added to the top of the stack of gloves;

wherein the floor is movable relative to the perimeter wall, so that, in use:

the floor may be moved relatively away from said opening so that as gloves are added to the stack of gloves, the perimeter wall continues to contain the stack of gloves;

the floor may be moved relatively toward said opening to remove the stack of gloves from the receptacle; and the perimeter edge of the floor is separated by a clear gap from the perimeter wall whereby the perimeter edge of the floor surface is not in contact with the perimeter wall, said clear gap being sufficiently wide so that lowermost gloves in the stack of gloves do not become trapped between the perimeter edge of the floor surface and the perimeter wall as the floor is moved relatively toward said opening.

24. A glove packing apparatus as claimed in claim 23, in which the apparatus further comprises a packing plate adapted to rest on said base of the receptacle and being configured to support the stack of gloves.

25. A glove packing apparatus as claimed in claim 24, in which the apparatus further comprises a packing element, the packing element being positioned between a lowermost glove in the stack of gloves and the packing plate, the packing element having tabs that cover over most of said clear gap.

26. A glove packing apparatus as claimed in claim 23, in which the floor surface proximate said perimeter edge extends above an overhang feature in said base of the receptacle.

27. A glove packing apparatus as claimed in claim 23, in which said base of the receptacle beneath said gap contacts the perimeter wall to guide the relative movement between said base of the receptacle and the perimeter wall.

28. A glove packing system for packing gloves into a container from which gloves may be dispensed, the glove packing system comprising a glove packing apparatus in combination with a stack of gloves, the glove packing apparatus comprising a receptacle and the stack of gloves being held by the receptacle for subsequent packing into said container, the glove packing apparatus comprising:

a receptacle for forming a stack of said gloves to be packed, a container having a closable opening into which the stack of gloves is to be packed, and a box-like carrier for holding the container with said opening configured to receive the stack of gloves within the container, wherein the receptacle has:

a perimeter wall, the perimeter wall having surfaces and said surfaces being configured to contain said stack of gloves;

a floor within the perimeter wall, the floor being provided by a base of the receptacle and the perimeter wall of the receptacle being provided by a sleeve, the sleeve having an open end that provides an opening to the receptacle opposite the floor into which additional gloves may be added to said stack of gloves, said opening to the receptacle being substantially square or rectangular;

wherein the floor is movable relative to the perimeter wall, so that, in use:

the floor may be moved relatively away from said opening so that as gloves are added to said stack of gloves, the perimeter wall continues to contain the stack of gloves; and the container held by the box-like carrier may be oriented so that the opening of the container faces the open end of the sleeve so that when the floor is moved relatively toward said opening to remove the stack of gloves from the receptacle the stack of gloves is thereby transferred from the receptacle and into the container.

29. A glove packing apparatus as claimed in claim 28, in which the container held by the box-like carrier may be oriented with the open end of the sleeve fitting inside the opening of the container so that when the floor is moved relatively toward said opening to remove the stack of gloves from the receptacle the stack of gloves is thereby transferred from the receptacle and into the container.

30. A glove packing apparatus as claimed in claim 28, in which said surfaces of the perimeter wall are configured to define the shape of a stack of gloves having four sides as gloves are added to said stack of gloves whereby said stack is substantially rectangular or square in outline around the four sides of the stack.

* * * * *